US008007379B1

(12) United States Patent
Cook

(10) Patent No.: US 8,007,379 B1
(45) Date of Patent: Aug. 30, 2011

(54) TENNIS RACKET WITH ADJUSTABLE BALANCE AND METHOD FOR USING THE SAME

(76) Inventor: Cristina M. Cook, Katy, TX (US)

( * ) Notice: Subject to any disclaimer, the term of this patent is extended or adjusted under 35 U.S.C. 154(b) by 0 days.

(21) Appl. No.: 12/542,401

(22) Filed: Aug. 17, 2009

Related U.S. Application Data

(60) Provisional application No. 61/090,003, filed on Aug. 19, 2008.

(51) Int. Cl.
*A63B 49/08* (2006.01)

(52) U.S. Cl. ..... 473/519; 473/549

(58) Field of Classification Search ..... 473/549, 473/552, 519, 524
See application file for complete search history.

(56) References Cited

U.S. PATENT DOCUMENTS

| | | | | | |
|---|---|---|---|---|---|
| 2,028,291 | A * | 1/1936 | MacPherson | 473/519 |
| 2,121,289 | A * | 6/1938 | Gleadall | 473/519 |
| 2,395,864 | A * | 3/1946 | Geerlings et al. | 473/519 |
| 3,907,292 | A | 9/1975 | Moreland | |
| 4,027,879 | A * | 6/1977 | Wright | 473/464 |
| 4,027,881 | A * | 6/1977 | Hufenus | 473/519 |
| 4,179,121 | A | 12/1979 | Kelmanski | |
| 4,325,549 | A * | 4/1982 | Vasselli | 473/519 |
| 4,427,195 | A | 1/1984 | Hufenus | |
| 6,254,502 | B1 * | 7/2001 | Becker | 473/594 |
| 6,257,997 | B1 * | 7/2001 | Doble et al. | 473/516 |
| 6,432,004 | B1 | 8/2002 | Nemeckay | |
| 6,461,259 | B1 * | 10/2002 | Li | 473/527 |
| 2004/0053715 | A1 * | 3/2004 | Schwieg et al. | 473/519 |
| 2010/0022326 | A1 * | 1/2010 | McClung et al. | 473/333 |

* cited by examiner

*Primary Examiner* — Raleigh W. Chiu
(74) *Attorney, Agent, or Firm* — William A. Loginov; Loginov & Associates, PLLC

(57) ABSTRACT

This invention provides a racket that allows for the adjustability of balance within the structure of the racket. The racket's adjustment mechanism and its function are easy to use and optimize any player's game. The adjustment mechanism resides in the handle in a manner that does not substantially (or in any way) alter the aerodynamic profile of the racket or affect its usability by providing unwanted external structures. Rather a movable mass/weight is contained within a hollow space of the handle and can be moved upwardly and downwardly along the handle using a guide mechanism and fixing or locking structure that can be illustratively activated by rotating a knob at the lower end of the racket handle (or by another low-profile external trigger). This can comprise a shaft with a thread or key that engages a corresponding thread or key slot on the mass/weight. The knob can include an indexing mechanism that facilitates rotatable restraint and/or alignment of the knob when not in use.

8 Claims, 4 Drawing Sheets

TENNIS RACKET WITH ADJUSTABLE BALANCE AND METHOD FOR USING THE SAME

RELATED APPLICATIONS

This application claims the benefit of U.S. Provisional Application No. 61/090,003, filed Aug. 19, 2008, entitled TENNIS RACKET WITH ADJUSTABLE BALANCE AND METHOD FOR USING THE SAME, by Cristina M. Cook, the entire disclosure of which is herein incorporated by reference.

FIELD OF THE INVENTION

This invention relates to a novel tennis racket design in general that may be utilized for training, demoing, as well as point play allowing players to adjust the balance of the racket between points or drills.

BACKGROUND OF THE INVENTION

Current tennis rackets come in a wide variety of designs with every racket having a predetermined balance. The performance of the racket is greatly affected by its balance—the weight distribution from head to butt cap. For the purpose of teaching/learning tennis (ranked in the top ten most difficult games to play), a head-heavy balance distribution is highly preferable for ground strokes, while a head-light distribution is preferable for volleys. To date, there is not a racket that allows the flexibility while learning the game to have both head-heavy and head-light in one racket.

With respect to demoing (the period of time before the purchase of a racket, when a player borrows several different rackets from a retail or other source to test before committing to a purchase), the ability to alter the balance of the racket allows the customer to borrow a single racket instead of many that they can adjust to their personal balance preference. A racket can then be finally selected based on the player's preferred balance selection. This narrows the purchasing field from several hundred distinct rackets and brands to just a few, thus drastically reducing the lag time before the purchase of a racket.

For general game play, different weight distributions in a racket accommodate different styles of play. For instance, someone who prefers playing from the baseline, a head-heavy (weight distribution toward the top or the head of the racket) balance might be most appropriate. Conversely, a head-light balance would be more suited to a serve and volley player. In regular game play a player often changes styles of play from point to point for various reasons including exploiting a particular opponent's weakness, or in response to an opponent exploiting their weakness, accommodating different court surfaces, weather conditions, or even personal temperament. The ability to alter the racket balance optimizes the racket for different styles of play from point to point. Creating a head-heavy balance shift can aid in countering headwinds or adding extra power to strokes that might not otherwise be generated. The different court surfaces—for example, clay courts slow down the ball and produce a high bounce, while grass courts are the fastest type of tennis court, and hard courts are considered "medium" surfaces—each favor different styles of play.

To address the singularity of balance within a racket several previous inventions have developed mechanisms, each of which has their own drawbacks. U.S. Pat. No. 6,432,004 B1, for example, proposes an add-on weight system that is pressure fit within the throat of the racket. This mechanism, while allowing for adjustability, interferes with the pre-established aerodynamics of the racket. It also places large amounts of pressure on the frame and provides extra pieces that can dislodge at high speed, and cause injury to a player or spectator. These same disadvantages are present in U.S. Pat. Nos. 4,179,121 and 4,427,195. An early concept for dynamically changing the racket balance during use is taught in U.S. Pat. No. 3,907,292. However, this concept is based on out-of-date racket technology that would not apply to modern constructions. Moreover, this approach is a violation of the ITF definition of a racket (due to the dynamically changing balance).

It is therefore desirable to provide a system that allows the balance of the racket to change while securely maintaining the chosen balance during play. The choice of the change becomes conscious and deliberate, thus educating the player [on the effects of balance] while improving their performance. The mechanism for allowing balance change should be easy to use, not compromise structural integrity of the racket, and maintain the original lines of the racket without protuberances or parts that can be accidentally dislodged. It should, more generally, allow the racket to comply with any applicable rules and regulations of the game.

SUMMARY OF THE INVENTION

This invention overcomes the disadvantages of the prior art by making the balance change a conscious decision made by the player between points, games, or exercises. The entirety of the mechanism is contained within the frame in the grip portion of the racket, thus eliminating undesirable stresses on the racket frame and the possible liability of loose parts. The mechanism replaces the current popular option of a static structure within the frame's grip for a different structural system, with a weight that can be adjusted according to the most desirable balance.

The mechanism may have different levels of complexity depending on the end purpose. For example, with a training device for learning purposes having 2 weight positions is sufficient (keeping the user interaction simple, while still allowing for both the head-heavy and the head-light positions), where as a mechanism for demo purposes and point play need more micro-adjustability. One variation is primarily a training device and has the ability for gross adjustments from head-heavy to head-light. An alternate mechanism allows for micro-adjustments along the entire length of the mechanism. The concept is easily altered for players at various levels of competition. The adjustment then becomes an additional control for the player when variables such as but not limited to, weather, court surface, opponent, personal play for that moment (ie switching weight distribution depending on the style of play desired for that particular point or micro-adjustments based on mistakes or weaknesses). The entirety of the mechanisms is contained within the racket (more specifically within the handle of the racket) so as to alleviate the problems encountered by previous art of altered aerodynamics and stray parts and safety. The racket itself adapts to its predecessors in appearance—thus generating an immediate understanding of its general use—while also providing a bit of extra customizability for optimized play.

An additional advantage to this system is that it affords a wider range of players the ability to play with the same racket. For families or clubs that have multiple players who may have differing styles of play, one racket can be purchased and adjusted to suit each individual when they are playing.

More particularly, this invention provides a racket that allows for the adjustability of balance within the structure of the racket. The racket's adjustment mechanism and its function are easy to use to use and optimize any player's game. The adjustment mechanism resides in the handle in a manner that does not substantially (or in any way) alter the aerodynamic profile of the racket or affect its usability by providing unwanted external structures. Rather a movable mass/weight is contained within a hollow space of the handle and can be moved upwardly and downwardly along the handle using a guide mechanism and fixing or locking structure that can be illustratively activated by rotating a knob at the lower end of the racket handle (or by another low-profile external trigger). This can comprise a shaft with a thread or key that engages a corresponding thread or key slot on the mass/weight. The knob can include an indexing mechanism that facilitates rotatable restraint and/or alignment of the knob when not in use.

In an illustrative embodiment, the racket handle includes a guide located within a hollow interior space of the handle. The guide extends between opposing ends of the hollow space. A weight or mass slides with respect to the guide between at least two opposing locations approximately adjacent to each of the opposing ends. A locking mechanism is constructed and arranged to selectively lock the weight in and unlock the weight from each of the opposing locations. The guide and the locking mechanism of the illustrative embodiment are each constructed and arranged to locate and lock the weight in at least one intermediate location along the handle between each of the opposing locations.

In one embodiment, the guide comprises a keyed shaft and the weight includes a corresponding key slot, the shaft being located between opposing locators within the handle that allow the shaft to rotate within a predetermined range to selectively lock and unlock the weight with respect to the shaft by moving the key out of and into alignment with the key slot, respectively. In another embodiment the guide comprises a threaded shaft and the weight includes a mating threaded hole, the shaft being located between opposing locators within the handle that allow the shaft to rotate to selectively move the weight along the handle to a predetermined adjustment location. In various embodiments requiring rotation of the shaft, the shaft extends externally to a butt end of the racket. The external portion of the shaft is operatively connected to a graspable knob attached to the shaft at the butt end that allows the shaft to be rotated thereby. An indexing mechanism can be provided to the knob to rotatably restrain and report alignment of the knob at a predetermined location with respect to the butt cap. In this manner, the user feels a "click" when the knob is appropriately aligned to lock or unlock the weight, and the knob is generally restrained from free movement in this position so that the adjustment remains fixed during racket use.

BRIEF DESCRIPTION OF THE DRAWINGS

The invention description below refers to the accompanying drawings, of which.

DETAILED DESCRIPTION

Figure 1:
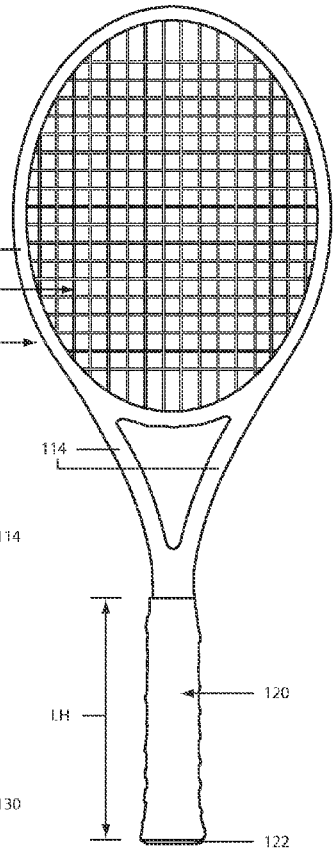
FIG. 1 (Prior Art)
FIG. 1 is a diagram showing the general shape of a typical, commercially available tennis racket according to the prior art.

FIG. 1 depicts a typical, modern, commercially available tennis racket 100 according to the prior art. The racket includes a strung head 110 with a frame 112. The head 110 extends downwardly to a pair of base members 114 (the throat) that interconnect with the racket handle 120. The handle 120 extends to a butt cap 122. The handle 120 includes a covering that enhances the user's grip. Most modern tennis rackets are constructed from a lightweight and durable composite, such as carbon fiber composite. To reduce weight, the handle 120 is often hollow along the majority of its length LH, and/or are filled with a lightweight foam filler. In either case, the handle is constructed from a shell that can provide an interior that can receive an internal balancing mechanism, surrounded by an outer shell. Where the racket design is such that a structural foam or other internal material is replaced with the mechanism, the mechanism can itself act as a reinforcing structure in accordance with this invention.

Figure 1A:
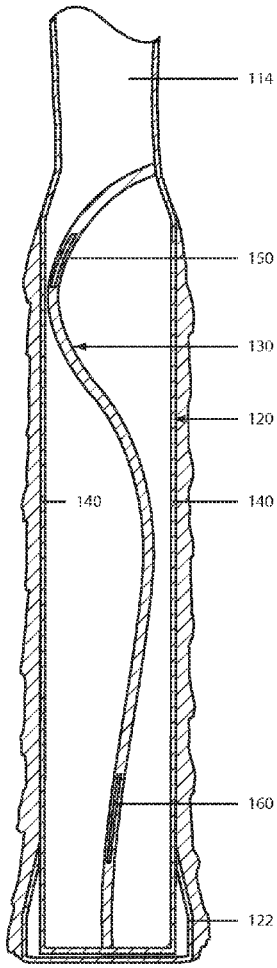
FIG. 1 A (Prior Art)
FIG. 1A is a side cross section showing the current rigid internal structure of the racket handle of the typical commercially available tennis racket of FIG. 1.
Figure 1B:
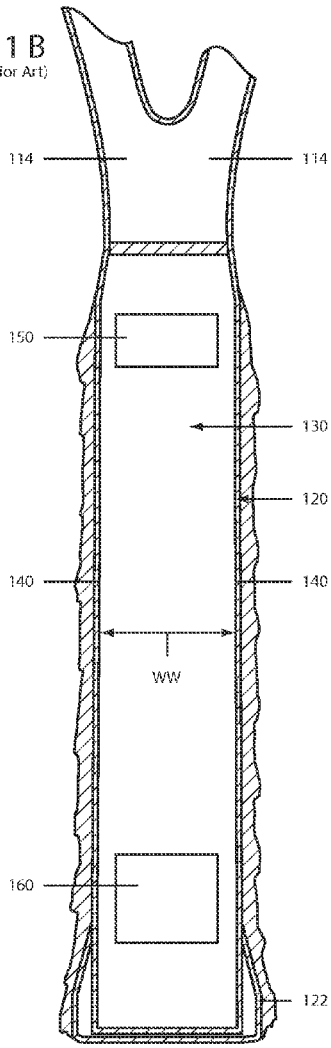
FIG. 1 B (Prior Art)
FIG. 1B is a frontal cross section of the racket handle of FIG. 1.

The internal structure of the hollow racket handle 120 is shown in further detail in side and front cross section in FIGS. 1A and 1B, respectively. FIG. 1A shows a side view of the wavy carbon fiber weighting structure 130 that is generally contained within the walls 140 of the handle 120. FIG. 1B shows a front view of the same weighting structure 130, detailing the structure's 130 full width WW across the interior of the handle 120. Fixed weights 150 and 160, which can define pieces of lead, are distributed at predetermined locations along the length of the structure 130 to achieve a specific set balance for that particular racket 100. In this example one weight 150 is located near the top of the racket handle and another is located at the bottom. The distribution of weights can be varied at the factory to customize the racket, but this requires careful placement of the weights in the structure 130.

Figure 2:
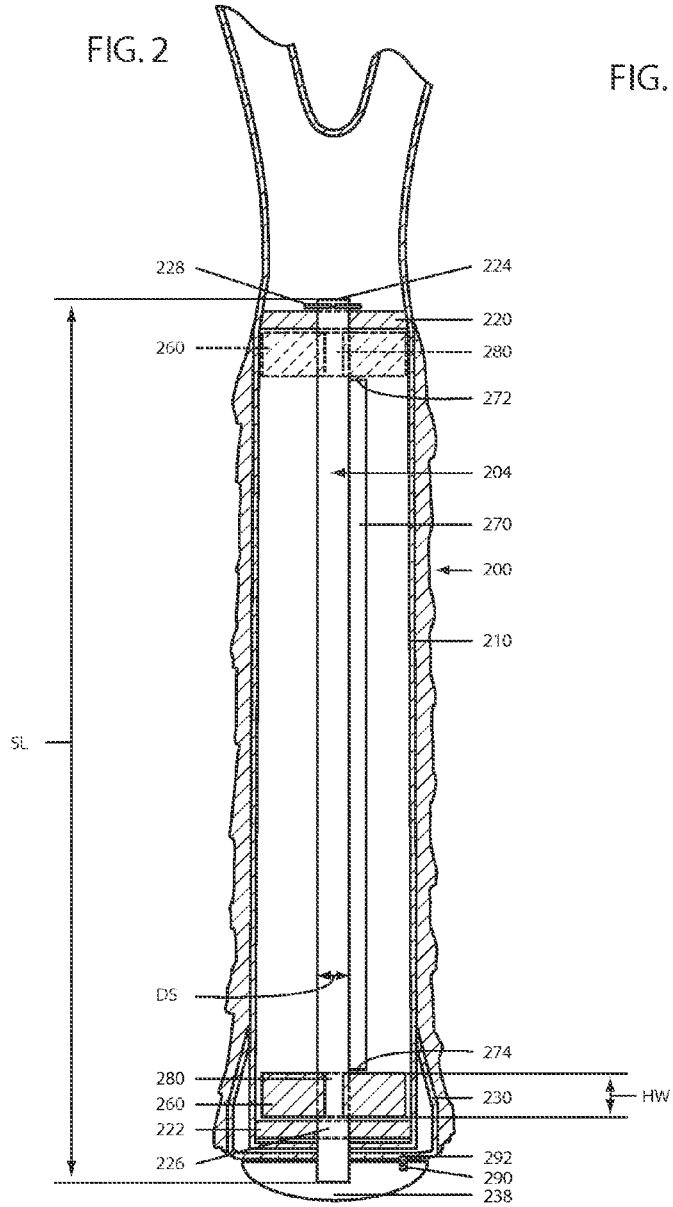
FIG. 2 is frontal cross section of a tennis racket handle having an internal mechanism that allows for gross balance adjustments according to an illustrative embodiment of the invention.
Figure 2A:
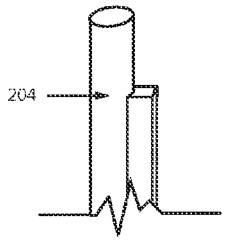
FIG. 2A is a partial perspective view of the internal rod for the handle of FIG. 2 showing the uppermost portion where the rod transitions from a keyhole cross section to a round cross section and where the weight is locked in place.
Figure 2C:
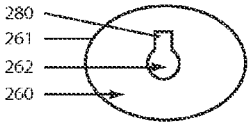
FIG. 2C is a top view of a weight used to effect a balance shift according to an illustrative embodiment of this invention, also showing the key hole that allows the weight to move along the shaft and be locked in place.

FIGS. 2-2C depict one the internal sliding mechanism contained within the handle 200 of the racket according to an embodiment of this invention. A central shaft 204 is contained within the material that makes up the shell walls 210 of hollow handle 200 between two locators 220 and 222 that are affixed at each of opposing ends of the interior of the handle 200. The locators 220, 222 can be inserted and adhered to the inner surface of the handle wall 210 using fasteners, adhesives or by molding techniques. The locators 220, 222 center the shaft 204 within the handle 200, and keep it stable and coaxially aligned with the handle. A pair of opposing through-holes in each of the respective locators 220, 222 each receive the opposing ends 224, 226 of the rod 204 and allow the rod 204 to freely rotate with respect to the locators. To axially retain the rod 204, a circlip, or other removable fastener 228 can be positioned along at least one portion of the rod (e.g. adjacent to the top surface of the top locator 220).

In FIG. 2 the rotatable central rod 204 is attached through the butt cap 230 (or another structure that defines the handle's butt end) via a through-hole, and secured to an external knob 238. When knob 238 is turned, (double curved arrow 240), it transmits rotation to the rod 204 itself. The knob can be relatively low in profile (axially) and fits within the perimeter of the butt cap 230. In this embodiment, it includes a pair of concave reliefs 250 that are sized and arranged to receive the user's fingers and assist in rotation the knob with respect to the butt cap 230. The surface of the knob 238 (or graspable portions thereof) is highly variable. It can be textured in an illustrative embodiment for greater gripping friction. Likewise, the knob 238 and other operatively connected components can be constructed from a variety of materials including, but not limited to, polymers, composites and/or metals.

A movable weight 260 can be constructed from lead, or another appropriate, high-density material, is provided within the handle interior. Its outer perimeter 261 is sized and arranged similarly, or approximately smaller than, the inner perimeter of the handle wall 210. As shown the weight 260 and corresponding handle inner perimeter are each ovular. Thus, the weight 260 is restrained from free axial rotation with respect to the handle 210. The weight 260 is slidable along the shaft 204 with a slot 262 that is sized similar to or greater than the diameter DS of the shaft 204.

Notably the shaft 204 includes a key 270 that extends radially from the cylindrical surface of the shaft. The key 270 includes opposing upper and lower ends 272 and 274, respectively, which are located so as to accommodate the height HW of the weight 260 when confronting either the upper locator 220 or lower locator 222. That is the weight 260 resides beneath the respective end 272, 274 of the key 270 in the uppermost (shown in phantom) and lowermost positions.

The weight defines a central hole 262 that includes a conforming key slot 280. The key slot 280 is sized to be similar to, or slightly larger than, the key 270 so that when the key 270 is rotationally aligned with the slot 280, the weight can pass over the shaft 204 and transition between the uppermost and lowermost positions. When not aligned the key ends 272 and 274 are interfered-with by the surface of the weight 260, thus preventing a sliding motion. In this manner, rotating the shaft 204 allows the weight to be selectively locked in place in either the uppermost or lowermost position, or unlocked to be slidable along the shaft to one or the other position. In this manner, the position is adjustable to either a head-heavy (weight in uppermost position or head-light (weight in lowermost position). The shaft length SL, and thus the weight shift distance, is determined by the length of the handle within which it is contained which can vary from racket to racket but the length of the shaft is generally made to optimize the full length of the handle.

Figure 2B:
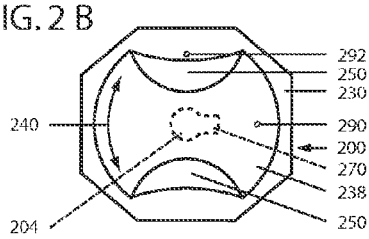
FIG. 2B is a top view of the butt cap of the racket handle of FIG. 2, showing the knob (user interface) which is used to rotate the rod, locking and unlocking the weight.

As shown in FIGS. 2 and 2B, the knob 238 facilitates rotation of the shaft 204 between the locked and unlocked positions. In this embodiment, to allow indexed positioning of the locked and unlocked states, the knob 238 and butt cap 230 include a spring-loaded ball assembly 290 and opposing detents 292 that allow the knob to be rotated into at least two perpendicular orientations wherein the knob is rotatably restrained in each position by a light-but-noticeable "click." A variety of other indexing mechanisms that allow restraint in each of the locked and unlocked positions are expressly contemplated and should be clear to those of ordinary skill.

Figure 3A:
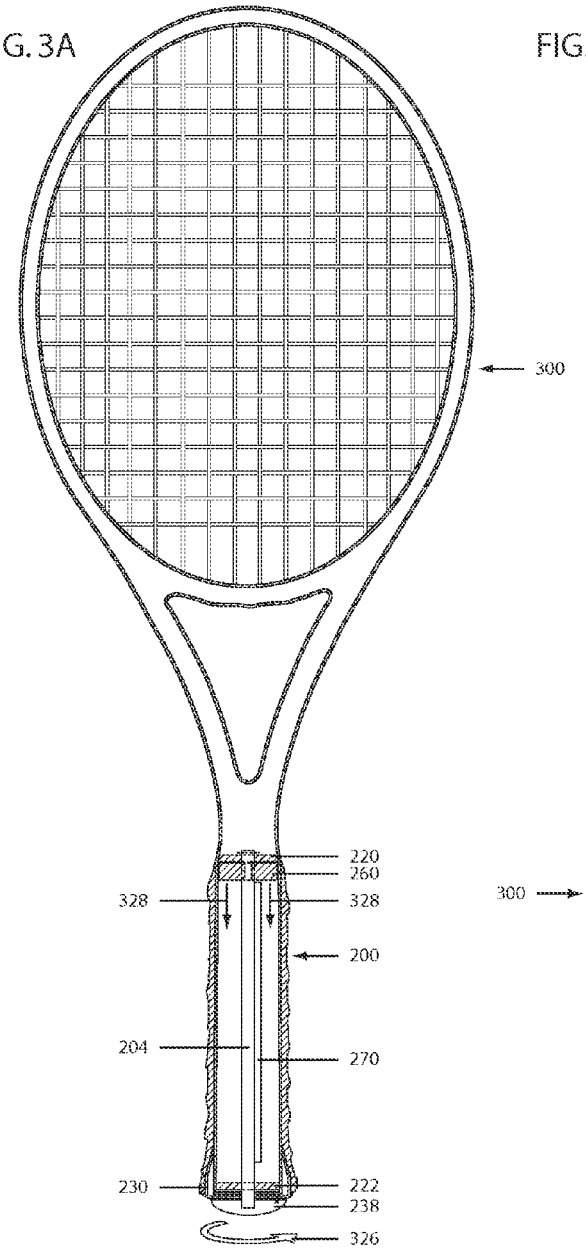
FIGS. 3A and 3B show partially exposed front views of the entire racket including a balance-adjustment mechanism in the handle according to the embodiment of FIG. 2, depicting how orienting the racket allows the user to utilize gravity to change the weight position.
Figure 3B:
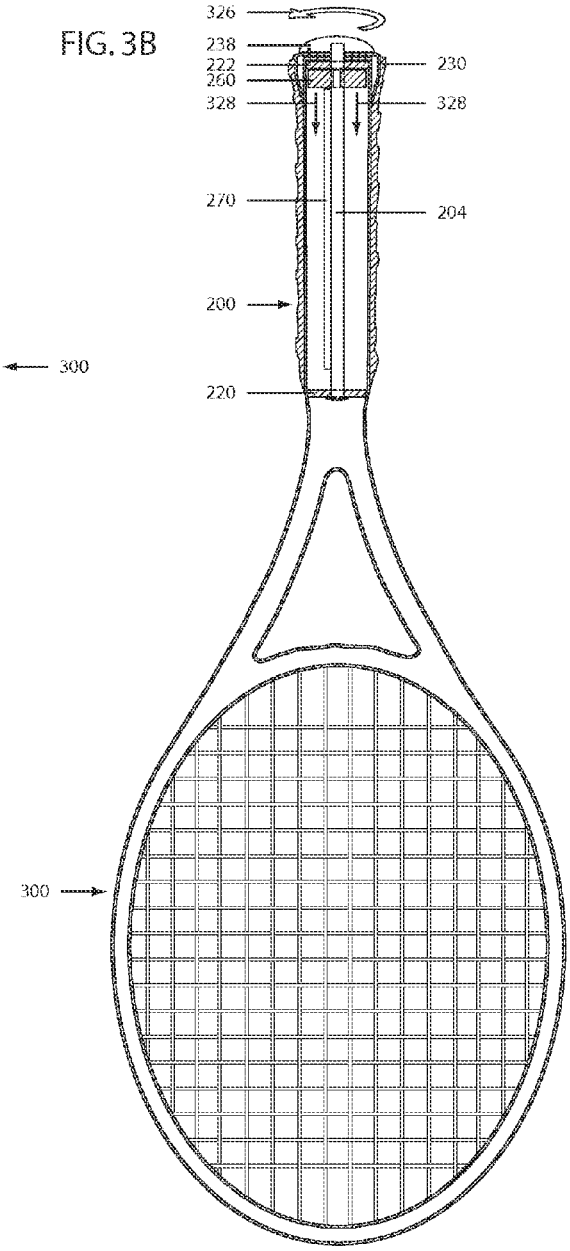
Figure 3C:
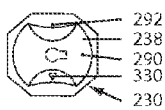
FIG. 3C shows a top view of the butt cap of the racket of FIGS. 3A and 3B in which the knob aligned (with indicator arrows askew) in the locked position.
Figure 3D:
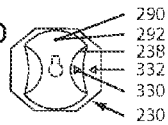
FIG. 3D shows a top view of the butt cap of the racket of FIGS. 3A and 3B in which the knob is in the unlocked position (with indicator arrows aligned)

As demonstrated in FIG. 3A and FIG. 3B, a racket 300 having the novel, adjustable handle 200 allows the weight 260 to be moved between resting positions through the use of gravity. By orienting the racket and turning (curved arrow 326) the knob 238 to the unlocked position (as shown in FIG. 3D where an indication arrow 330 on the knob 238 is aligned with another arrow 332 on the butt cap 230.), allowing the weight 260 to shift (arrows 328) to one end and then locking knob 238 (as shown in FIG. 3C wherein the knob arrow 330 is not aligned with an arrow 332 on the butt cap 230). This position indicates that the weight is locked in place, either in the head-heavy (FIG. 3A) or head-light (FIG. 3B) orientation.

Figure 4:
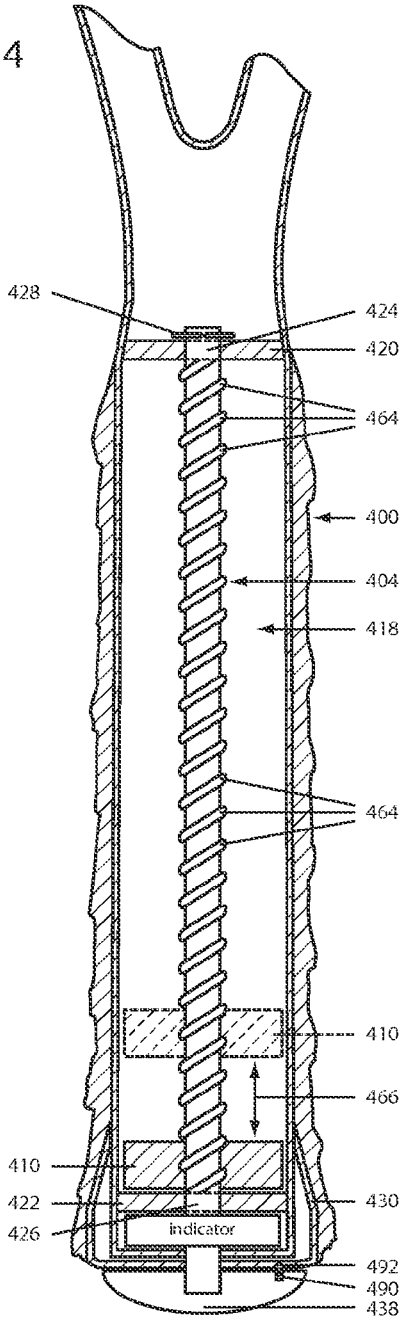
FIG. 4 is a frontal cross section front view of a threaded shaft and weight mechanism which allows for micro-adjustments of balance within the racket handle according to an illustrative embodiment.
Figure 4A:
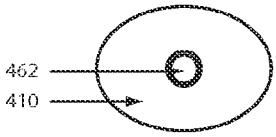
FIG. 4A is a top view of a weight that moves along the threaded shaft within the racket handle.
Figure 4B:
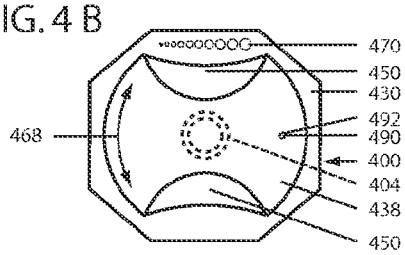
FIG. 4B is a top view of the racket handle's butt cap showing the knob (user interface) which allows for the manipulation (up and down the threaded shaft) of the weight with an optional external indicator to show the weight location.

FIGS. 4-4B depict an alternate embodiment of a racket handle 400 that can be part of an overall tennis racket as described herein. The handle 400 allows for micro-adjustment of the position of the internal weight 410. The handle 400, thus includes a pair of opposing upper and lower locators 420 and 422 that are affixed within the inner perimeter of the handle's hollow space 418. A threaded shaft 404 runs down the central axis of the handle 400, and through holes in each of the locators 420 422. The shaft 404 rotates freely with respect to the locators 420, 422, as the opposing ends 424 and 426 of the shaft 404 are unthreaded and cylindrical. The shaft 404 can be secured to the upper locator 420 by a circlip or similar retaining structure 428 as shown. Again, the central shaft 404 is attached through the butt cap 430 to a knob 438. Notably, the weight (FIG. 4A) includes a threaded central hole 462. The size and pitch of the threaded hole 462 of the weight 410 matches the size and pitch of the threads 464 on the shaft 404. By rotating the knob 438, and hence the shaft 404, the weight moves (double arrow 466) along the inner space 418 of the handle 400 between a lowermost (as shown) position adjacent to the lower locator 422, a highly variable central position (an example being shown in phantom), and uppermost position, adjacent the upper locator 420. The pitch of mating threads determines the distance weight 208 travels with each 360-degree rotation (double curved arrow 468) of knob 438. A greater thread count along threaded shaft 404 allows for greater micro-adjustment. Each full rotation of knob 438 moves the weight a predetermined distance along threaded shaft 404—depending upon the pitch of the threads. The internal geometry of the handle and weight or another anti-rotation component can prevent the rotation of the weight as the shaft rotates, thereby ensuring that rotational motion of the shaft is translated into axial movement for the weight.

The direction of the movement of weight 410 is determined by the direction of rotation of knob 438 and thus threaded shaft 404. The rectangle labelled 'indicator' located below the lower locator 422 can contain a gear/cog system, digital meter, or any other mechanical or digital means of translating the movement of weight 410 to external readout/indicator 470. The external readout 470 can be digital or mechanical or any other method that translates the movement of weight 410 into readable information for the user to see. The external readout 470 is represented in the illustrative embodiment by a series of circular cut-outs through butt cap 430 which progressively increasing in diameter, indicating their increasing closeness to the head heavy weight extreme at the top of handle 400. As the weight 410 travels up threaded shaft 404 more of the circular cut-outs of external readout 470 are darkened—shown here with the smallest circle filled depicting weight 410 at the bottom of the handle 400. The knob 438 can include grip structures 450 to assist in grasping the knob as it is rotated. It can also include an indexing structure that allows the knob 438 to be restrained against free rotation. In this example a ball and spring 490 assembly engages a detent 492 in the butt cap 430. Rotation overcomes the engagement pressure. Each time the knob rotates 360 degrees (in this embodiment) the user feels a click. The knob can be restrained in the engaged position after a click is felt, and will remain in that position with the weight moved to the appropriate location within the handle.

It should again be noted that, in any of the embodiments herein the mechanism for indexing and/or locking/unlocking the knob with respect to the handle is highly variable. In alternate embodiments, the knob can be replaced with another component such as a hex-wrench socket provided within the butt cap. Likewise the knob can be secured to the shaft in any acceptable manner, using, for example pins, screws, splines, keys and the like. The shaft can, itself be mounted into the handle in a variety of manners. Also, while a shaft is used to move and lock/fix the weight, in alternate embodiments another structure that surrounds the outside of the weight (a rotatable, threaded cylinder provided within the handle for example) can be used to move and lock/unlock the weight.

It should be clear that the various embodiments herein define a novel racket, for use in a variety of sports. In general each racket defines a frame structure, generally conventional in size, shape, appearance and overall weight, but constructed and arranged to allow multiple weight distribution characteristics in response to a manipulation of an internal weight and external adjustment mechanism by the user. In this manner, the racket is readily adjustable to the user's specification without the need of external weights or other impractical, and non-regulation structural components.

The foregoing has been a detailed description of illustrative embodiments of the invention. Various modifications and additions can be made without departing from the spirit and scope if this invention. Each of the various embodiments described above may be combined with other described embodiments in order to provide multiple features within a single embodiment. Furthermore, while the foregoing describes a number of separate embodiments of the apparatus and method of the present invention, what has been described herein is merely illustrative of the application of the principles of the present invention. For example, the threaded rod and the keyhole rod are just two options on how to embody this concept. In alternate embodiments the movement and locking of the weight at different locations along the handle can be effected using external locking structures (for example screws or spring-loaded, trigger activated buttons located along the side of the handle. A ratchet mechanism can also be used to move and fix the weight at various locations along the handle. The weight may also be guided along the handle interior by a plurality of guide structures, such as channels. The weight assembly can in fact be provided to the hollow part of the handle as a separate insert assembly that is passed into the base during construction of the racket. Likewise, a rotatable key shaft can also be provided with intermediate areas that are non-keyed so that careful sliding of the weight can deposit the weight at such intermediate locations. In one embodiment, the key in each portion of the shaft (between non-keyed sections), can be located at a slight arcuate offset. In this manner, the weight stops at each intermediate location resting on the slightly misaligned key section's end, and requiring a slight twist of the shaft to align the next key section and thereby pass the weight onto that next key section. Finally, while the principles herein are applied to a tennis racket, the terms "tennis racket" and "handle" should be taken broadly to include other handheld sporting rackets and implements (for example, racquetball rackets, squash rackets, bats, etc.) that would benefit from the ability to adjust weighting over a predetermined range. Many other variations on style of the central rod and shape and dimension of the individual pieces can yield the same results. Likewise, the appearance of the indicator, if employed, can be highly variable. Accordingly, this description is meant to be taken only by way of example, and not to otherwise limit the scope of this invention.

What is claimed is:

1. A racket having a handle with adjustable weighting comprising:

a guide located within a hollow interior space of the handle, the guide extending between opposing ends;

a weight that slides with respect to the guide between at least two opposing locations approximately adjacent to each of the opposing ends; and a locking mechanism constructed and arranged to selectively lock the weight in at least at an uppermost position and at a lowermost position, and selectively unlock the weight when sliding along the guide between each of the opposing locations.

2. The racket as set forth in claim 1 wherein the guide comprises a keyed shaft and the weight includes a corresponding key slot, the shaft being located between opposing locators within the handle that allow the shaft to rotate within a predetermined range to selectively lock and unlock the weight with respect to the shaft by moving the key out of and into alignment with the key slot, respectively.

3. The racket as set forth in claim 2 wherein the shaft extends externally to a butt end of the racket and further comprising a graspable knob attached to the shaft at the butt end that allows the shaft to be rotated thereby.

4. The racket, as set forth in claim 3, wherein the knob and the butt end includes an indexing mechanism that reports movement and restrains alignment of the knob in at least one orientation in which the weight is locked and an orientation in which the weight is unlocked.

5. The racket as set forth in claim 1 wherein the racket defines a tennis racket.

6. A racket comprising:

a frame structure constructed and arranged to allow multiple weight distribution characteristics in response to a manipulation of an internal weight and external adjustment mechanism by the user by selectively locking the internal weight when in at least an uppermost position and a lowermost position and unlocking the weight when sliding along the guide between the uppermost position and the lowermost position.

7. The racket as set forth in claim 6 wherein a movable mass is contained within the handle of the racket.

8. The racket as set forth in claim 7 wherein an adjustment and fixing mechanism is constructed and arranged so that the mass can be adjusted up and down inside of the racket's handle so that the racket's center of gravity can be changed.

* * * * *